US005996807A

United States Patent [19]

Rumpf et al.

[11] Patent Number: 5,996,807

[45] Date of Patent: Dec. 7, 1999

[54] SCREENING DEVICE

[75] Inventors: Wolfhard Rumpf, Rödermark; Paul Gerhard Dellmann, Darmstadt, both of Germany

[73] Assignee: Dietrich Reimelt KG, Rödermark, Germany

[21] Appl. No.: 08/581,593

[22] PCT Filed: May 2, 1994

[86] PCT No.: PCT/EP94/01393

§ 371 Date: Jan. 17, 1996

§ 102(e) Date: Jan. 17, 1996

[87] PCT Pub. No.: WO95/02466

PCT Pub. Date: Jan. 26, 1995

[30] Foreign Application Priority Data

Jul. 17, 1993 [DE] Germany ..... 43 24 066

[51] Int. Cl.[6] ..... B07B 1/49

[52] U.S. Cl. ..... 209/401

[58] Field of Search ..... 209/392, 401, 209/406, 288, 300, 303, 305

[56] References Cited

U.S. PATENT DOCUMENTS

| | | | |
|---|---|---|---|
| 2,604,989 | 7/1952 | Warhol | 209/401 |
| 2,984,357 | 5/1961 | Kufferath | 209/401 |
| 3,620,368 | 11/1971 | Comis et al. | 209/401 X |
| 3,716,138 | 2/1973 | Lumsden | 209/401 |
| 4,120,785 | 10/1978 | Kanamori et al. | 209/401 |
| 4,491,517 | 1/1985 | Janovac | 209/401 |
| 5,039,412 | 8/1991 | Marsh | 209/401 X |

FOREIGN PATENT DOCUMENTS

| | | |
|---|---|---|
| 1648368 | 5/1971 | Germany . |
| 2443548 | 3/1976 | Germany . |
| 2847153 | 5/1980 | Germany . |
| 3143779 | 7/1982 | Germany . |
| 3227020 | 10/1984 | Germany . |

*Primary Examiner*—David H. Bollinger
*Attorney, Agent, or Firm*—Friedrich Kueffner

[57] ABSTRACT

Described is a screening device (1) with a screen fabric (2) having two groups of threads, the threads of one group running substantially orthagonal to the threads of the other group. A screening device of this kind can be more easily monitored to detect breaks in the screen fabric. For this purpose, electrically or optically conductive threads are provided in the second group at a predetermined lateral distance from one another. The threads of the second group are mechanically supported by the threads of the first group and are insulated relative to one another at least in some portions electrically or optically with respect to the physical quantity. An input arrangement and output arrangement (6, 7) is provided, respectively, at two edges of the screen fabric (2) which extend substantially parallel to the threads of the first group, this input arrangement and output arrangement (6, 7) being connected at least with the conductive threads of the second group in a conducting manner.

26 Claims, 3 Drawing Sheets

SCREENING DEVICE

The invention is directed to a screening device with a gauze or screen fabric having two groups of threads, the threads of one group running substantially orthagonal to the threads of the other group.

Screening devices, also referred to in the following as screens for the sake of brevity, are needed in a great many applications for sorting out particles from a product which do not exceed a determined size. Such screens are also used, among other things, for obtaining a starting product which is free of foreign bodies. The foodstuffs industry and pharmaceutical industry are especially important fields of use. In this case, products intended for human consumption must be prepared. For instance, flour must be screened so that it is free from foreign bodies such as stones. In nut grinding, it must be ensured that no nut shells are contained in the end product. Such stones or nut shells, if bitten, can cause injury to the consumer.

The screen fabric is relatively highly stressed, among other things by vibrations which occur when the material to be screened is moved across the screen fabric. Without such movement, however, satisfactory screening cannot be ensured in practice. The stresses can result in damage to the screen fabric. In this case, a hole is made in the screen fabric which is larger than the mesh width so that particles of a size which should be sorted out, per se, reach the starting product. Even if the defect is detected, a relatively large amount of the starting product must generally be reprocessed to ensure that no unwanted foreign bodies have been introduced into the starting product accidentally since the occurrence of the defect. As this is very expensive and also involves a relatively high liability for the producer, the screen fabrics are changed periodically at intervals which are so selected that the probability that no defect has yet occurred in the screen fabric is very high. Consequently, the intervals must be very short. Many screen fabrics are still completely intact when exchanged so that the premature exchange, in principle, represents a waste of material. Moreover, the amount of labor involved in exchanging the screen fabric is relatively high because the screening device must be at least partially disassembled. On the other hand, it is not possible to rule out every defect with certainty.

For this reason, various suggestions have been made in the past for monitoring the screen fabric by means of auxiliary devices. For example, a device for monitoring wear in material webs exposed to operating stresses is known from DE 24 43 548 A1. In this device, at least one electrically conducting control thread is introduced at intervals in the material web to be monitored. This electrically conducting control thread is connected with a measuring device for determining the increase in its electrical resistance in order to detect the cross-sectional reduction of the control thread which is concomitant with wear. However, this results in the problem of additionally introducing a control thread in the material web. This control thread causes local changes in the movability of the screen fabric which becomes harder in the region of the control thread. This also changes the vibrating behavior of the screen fabric which leads to the risk of increased susceptibility of the screen fabric to breakage in the vicinity of the control thread. Further, a control thread of this kind allows only a relatively crude monitoring of the screen fabric. Generally, damage confining itself to the size of a few meshes cannot be detected.

A similar design is known from DE 28 47 153 A1. In this case, another electrically insulated wire system is woven into the wire gauze. This wire system runs axially along the entire circumference of the screening drum with laterally closely spaced hairpin windings and is connected to a power source.

DE 31 43 779 A1 shows a device on sifting devices or screening devices for monitoring sifting cloths or screening cloths for crushing and sorting installations in the metallurgical and stone industries in which a circuit loop is secured in or at the cloth in regions of the cloth between the sifting or screening holes, this circuit loop being connected to an electrical circuit which is connected in turn to an electrically actuated monitoring, recording or alarm device. A break or a short circuit in the circuit loop indicates damage at some location in the cloth. This damage is detected and displayed electrically. The problem in this case, also, consists in that the damage cannot be detected with adequate reliability. In particular, the circuit loop can become detached from the cloth which may not necessarily be noticed so that subsequent damage to the cloth cannot be detected at all.

Further, it is known from DE 16 48 368 A1 to measure a component of a beam striking and reflecting from the abrasion surface of the screening device at a determined angle of incidence, which component changes as the abrasion changes. A signal is triggered when the maximum permissible degree of wear of the screen fabric is reached. This process is intended for use in the paper industry where the paper screens are formed of wires having a suitable reflecting behavior.

The object of the present invention is to provide a screening device which enables defects to be monitored with high reliability.

This object is met in a screening device of the type mentioned above in that the screen fabric is conductive for a physical quantity by means of threads of the second group which are spaced at predetermined lateral intervals, in that the threads of the second group are mechanically supported by the threads of the first group and are insulated relative to one another, at least in some portions, with respect to the physical quantity, and in that an input arrangement and output arrangement is provided, respectively, at two edges of the screen fabric which extend substantially parallel to the threads of the first group, this input arrangement and output arrangement being connected at least with the conductive threads of the second group for the input and output of the physical quantity.

The physical quantity under consideration is particularly electrical current, but other flowing media, light, sound, pressure may also be used as physical quantities. The construction of the threads of the second group is governed by the quantity to be transmitted, i.e., conducted. In the case of current, electrical conductivity is required. Light-transmitting ability is required in the case of light. When flowing media such as gases are conducted, a suitable conduit must be provided. Pressure can either be conducted through the threads via a suitable conduit or, in the case of negative pressures, i.e., when formed as tensile forces, can act directly on the threads. For the sake of simplicity, the invention will be described in the following chiefly with reference to electrically conductive threads, the input and output arrangement being designed as an electrode arrangement. However, the invention is not limited thereby. When other physical quantities are used, the property "electrical" should be replaced by the necessary property for the corresponding physical quantity, e.g., by "optical" when light is used as the physical quantity. The same applies for the term "electrode arrangement". In the present instance, in contrast to previously known devices, defects are no longer monitored indirectly by additional auxiliary devices which are introduced into the screen fabric, but rather directly by means of the screen fabric itself. The screen fabric itself can thus be monitored for wear or damage in that its conductivity or its resistance to the physical quantity is determined continuously or in discrete time intervals. Accordingly, the vibrating behavior of the screen fabric is also not negatively influenced by additional control threads or circuit loops. Rather, the screen fabric can be constructed in a relatively homogeneous fashion so that additional stresses due to "trouble spots" caused by the vibration of the screen fabric can be prevented. Monitoring is also more reliable because there are no longer auxiliary devices that can detach from the screen fabric. On the contrary, the means employed for monitoring are integral component parts of the screen fabric which are essential to its screening function. The permissible defect tolerance can be adjusted by means of the lateral spacing of the conductive threads in the second group. When a hole is formed in the screen fabric, a thread of the second group is damaged. This can be displayed directly. Since the threads of the second group are not only mechanically supported by the threads of the first group, but are also insulated from one another at least in some portions thereof, good defect monitoring can be achieved by relatively simple means because the breaking of a conductive thread of the second group leads to a distinct change in resistance which can be detected for the purpose of triggering an alarm.

All threads of the second group are preferably conductive for the physical quantity. In this way, it is ensured on the one hand that even the slightest defects in the screen fabric can be detected. On the other hand, monitoring of defects can also accordingly be effected in steps. In many cases, the tearing of only one thread is not critical because the opening formed in the screen is still small enough to block any unwanted foreign bodies. In such a situation, although a warning is given that damage has occurred because the resistance of the screen fabric has changed, it is not yet necessary to exchange the screen fabric. Such exchange may be carried out at the next opportunity, e.g., during regular maintenance. The screen fabric need only be exchanged when a second thread tears. If desired, this may be refined in such a way that it can be determined which thread has torn, so that the screen fabric need only be changed immediately when two adjacent threads are torn.

The physical quantity is preferably electrical current and the conductive threads of the second group are electrically conducting. In this case, monitoring need only determine whether or not the electrical resistance has changed. A sudden increase would then indicate that a thread had broken. Electrical current is relatively easy to manage and measure. Conventional or, if necessary, modified measuring devices can be used for further processing of the measurements.

The physical quantity is also preferably light and the conductive threads of the second group are designed as light guides. In this case, the connection, i.e., the input and output of the light, is somewhat more difficult than in the case of electrical current, especially because the input and output arrangements cannot be kept free of the product to be screened. Nevertheless, light has certain advantages as a measured quantity since it permits thread breakage to be detected with high accuracy.

The threads of the first group are preferably formed as warp threads and the threads of the second group are preferably formed as weft threads. As a rule, the warp threads have greater strength than the weft threads. If weft threads are used for monitoring defects, the weaker element in which the occurrence of a defect is more likely is monitored. This further increases the reliability of defect monitoring.

The screen fabric is preferably formed as a synthetic-fiber woven fabric, wherein threads of the second group have fibers which are formed of a plastic which conducts the physical quantity and which are in a conductive relationship with the physical quantity. Synthetic-fiber woven fabrics have the necessary elasticity and vibrating capability. Fibers formed of a plastic which conducts the physical quantity, in particular carbon fibers, frequently possess characteristics similar to those of other synthetic fibers so that when these fibers are used a woven fabric can be achieved which is homogeneous in both of its surface directions and exhibits a correspondingly uniform vibrating behavior and does not tend to break at individual trouble spots. Further, the stability of carbon fibers with respect to vibrational loading is much greater than that of metal wires. Individual metal wires often become brittle under vibrational loading so that they break easily. In this case, the monitoring possibility for monitoring the woven fabric would cause premature wear.

In a particularly preferable manner, the synthetic fibers are formed of polyester or polyamide, the threads of the second group being formed of polyester or polyamide with carbon or from carbon only. Such a composition has proven advantageous as screen fabric.

The conductive threads of the second group preferably have a support in each instance which is covered by a conductive layer at least along a portion of its circumference. The characteristics of conductivity and stability under mechanical loading can accordingly be separated and assigned to different components of the threads. The mechanical load is absorbed by the support. The conductivity is ensured by the covering layer. For this purpose, it is not absolutely necessary for the support to be enclosed entirely by the layer in the circumferential direction. It is highly probable that the layer will first be worn off during operation resulting in a gradual increase in resistance. It can then be decided on the basis of this increase in resistance whether or not to exchange the screen fabric.

The threads of the second group are preferably combined to form bundles of at least two individual threads, at least one thread of a bundle being conductive. Thus, the threads need not be constructed as individual threads. They can also be composed of a plurality of threads, in which case a thread bundle is arranged between individual holes or meshes of the screen. Accordingly, on the one hand, the mechanical stability of the thread bundle can be selected relatively independently of the mechanical stability of a thread conducting the physical quantity. On the other hand, the homogeneity of the screen is not disrupted. Protection against defects is not impaired by the thread bundle. Provided that at least one thread of the bundle is still intact, the screening function is fully maintained. It is only when all of the threads of a bundle are torn that the screening function is no longer ensured against defects. However, in this case the conductive thread is also torn.

The principle movement direction of the product to be screened relative to the screen fabric is preferably substantially vertical to the threads of the second group, the conductive thread of the thread bundle, of which there is at least one, being arranged behind a nonconducting, mechanically stronger thread of the bundle as viewed in the principle movement direction. The thread which is conductive for the physical quantity is situated so-to-speak "alee" of the mechanically stronger thread which does not necessarily conduct the physical quantity. Accordingly, the mechanical loading capacity of the screen fabric can also be selected relatively independently of the mechanical loading capacity of an individual conductive thread. Nevertheless, protection against defects is not impaired. In most cases, the mechanically stronger thread which is exposed to the material pressure will tear first. As long as the conductive thread remains intact, the screening function is not impeded. However, the conductive thread will tear shortly thereafter and a defect warning will be generated.

The input arrangement and output arrangement advantageously connect at least some of the threads of the second group in parallel. Accordingly, the input arrangement and output arrangement can have a relative simple construction. The measurement circuitry is accordingly also relatively simple.

The screen fabric is also preferably mechanically supported by the input arrangement and output arrangement. Accordingly, the input and output arrangements function not only as the measuring circuitry for the screen fabric but also serve for mechanical support. The support can accordingly also be monitored so that damage to the support of the screen fabric which could likewise lead to contamination of the starting product can be detected.

The input arrangement and output arrangement are preferably supported, respectively, at a frame via a support which is insulated for the passage of the physical quantity. The screen fabric is accordingly insulated relative to the screening device with respect to the physical quantity. Protective measures need no longer be taken.

At least one spacer is provided which acts on the input arrangement and output arrangement and tensions the screen fabric. This spacer is conductive and is connected at one end with an input or output arrangement so as to be conductive and has, at the other end, a connection for the passage of the physical quantity, the other input or output arrangement for the passage of the physical quantity being insulated from the spacer and having a suitable connection for the input and output of the physical quantity. Accordingly, the spacer provides not only for the mechanical tensioning of the screen fabric, which is necessary for a satisfactory functioning of the screening device, but also serves as the connection for the physical quantity by which an input arrangement and output arrangement can be connected to a measuring device, specifically on the same side of the screen fabric as the other input arrangement or output arrangement. As a result of this step which appears relatively simple, handling of the screening device is improved very substantially. The connection for monitoring resistance can be effected proceeding from one side.

Also, the screen fabric is preferably suspended at the spacer between the two input and output arrangements. The screen fabric and accordingly the screen can now be made relatively long and the screening capacity can be increased accordingly without the occurrence of excessive mechanical loading due to the long length. The screen fabric is supported "along the way" and obtains its desired shape due to its suspension at the spacers.

The spacer is preferably arranged on the delivery side of the screen fabric. The spacer is accordingly acted upon only by starting product which has already been screened. This reduces the risk of damage to the spacer.

In a particularly advantageous design, the screen fabric is arranged in the shape of a hollow cylinder, the threads of the second group running substantially parallel to the cylinder axis. In this way the desired relative movement between the material to be screened and the screen can be achieved by means of a crusher mechanism rotating in the hollow cylinder or, in more unusual circumstances, by a rotation of the hollow cylinder about its axis. The input arrangement and output arrangement are then advantageously located at the end sides of the hollow cylinder so that the entire length of the screen fabric is monitored.

For this purpose, the input arrangement and output arrangement are preferably designed as high-grade steel rings or special-steel rings. The special-steel rings serve at the same time to support the screen fabric so as to hold it in the desired cylindrical shape. Special-steel rings have outstanding electrical conductivity. Further, they have sufficient mechanical resistance to wear due to the product to be screened.

An auxiliary electrode formed of material with good electrical conductivity is preferably arranged between the special-steel rings and the conductive threads of the second group. The auxiliary electrode can be formed, for example, by a copper ring or another favorably conductive metal or plastic. It improves and renders uniform the transition resistance between the special-steel rings and the conductive threads, thus reducing the risk that defect warnings will be generated due to varying resistance when the screen fabric is undamaged.

The screen fabric is preferably tensioned between the input arrangement and output arrangement so as to be substantially flat. In this case, the screen fabric forms a plansifter.

A resistance measuring device is preferably provided which is connected with the two input and output arrangements so as to be conductive and which generates a warning signal in the event of an increase in the resistance to the input and output of the physical quantity between the two input and output arrangements. Thus, a simple measurement of resistance is sufficient in order to detect a defect in the screen fabric. This is true in a corresponding sense for other physical quantities. In this case, the transmissivity of the respective quantity must be determined.

The resistance measuring device also preferably contains a differential element which determines the change in resistance over time, wherein it triggers the warning signal when the change in resistance per unit of time exceeds a predetermined measurement. Accordingly, it is possible to prevent a series of defect warnings which could occur, for instance, if the change in resistance is caused by the change in ambient temperature rather than by damage to a thread. As a rule, a change of this kind takes place relatively slowly, while the change in resistance due to breakage of a thread is effected relatively suddenly. The reliability of the screening device is also increased in this way.

Predetermined quantities of threads of the second group are preferably combined in subgroups and each group is connected, as such, with the resistance measuring device. Accordingly, it is possible not only to measure the resistance of all parallel-connected threads, but also to select only small partial amounts of the plurality of threads and measure their resistance. On the one hand, the measuring accuracy can be increased in this way. On the other hand, it can be determined whether or not changes in resistance develop in the same direction, which would indicate causes other than the destruction of the woven fabric, e.g., a change in temperature.

For this purpose, it is particularly preferred that the resistors of at least two subgroups form a part of a bridge circuit. In a bridge circuit of this kind, the branches can first be balanced. If the resistance of one subgroup changes, this change is compensated for by a change in the other subgroup in the same direction. When a change in resistance occurs in only one subgroup but not in the other or if the changes in resistance differ from one another drastically, a signal is generated which indicates a defect situation.

Also, the resistance measuring device preferably has a control device which determines measured values in time intervals and stores them in a memory or storage. This procedure has a number of advantages. For one, monitoring of the screen fabric can be documented and monitored over a longer period of time with the aid of the measurement values stored in the storage. Further, this affords the possibility of monitoring in different steps.

In particular, the control device can subject the measured values to a short-term comparison and a long-term comparison and, if required, can examine them to ascertain whether a predetermined threshold value has been exceeded. The short-term comparison can be effected within the framework of minutes. For example, the current measured value can be compared with the next to last measured value preceding it. In this way, minor disturbances resulting, e.g., from a change in load, can be eliminated to a great extent. The long-term comparison which comprises a period or 30 minutes or an entire hour permits an analysis of the development of the resistance value. Accordingly, steps can be taken to exchange the screen fabric based on evidence of impending damage even though the screen fabric is not yet damaged. In so doing, there are three available findings. When the resistance value exceeds a predetermined threshold value, there is a defect. When a short-term change occurs, the probability of a defect is likewise relatively high. With a long-term change, a progressively deteriorating resistance value indicates impending damage due to wear.

The invention is described in the following with reference to a preferred embodiment example in conjunction with the drawings.

In the description, reference is had first to an embodiment form which operates by means of electric current as physical quantity.

A screening device 1 has a screen fabric 2 having the shape of the outer surface of a hollow cylinder.

Figures 2, 3, 4, 5, 10:
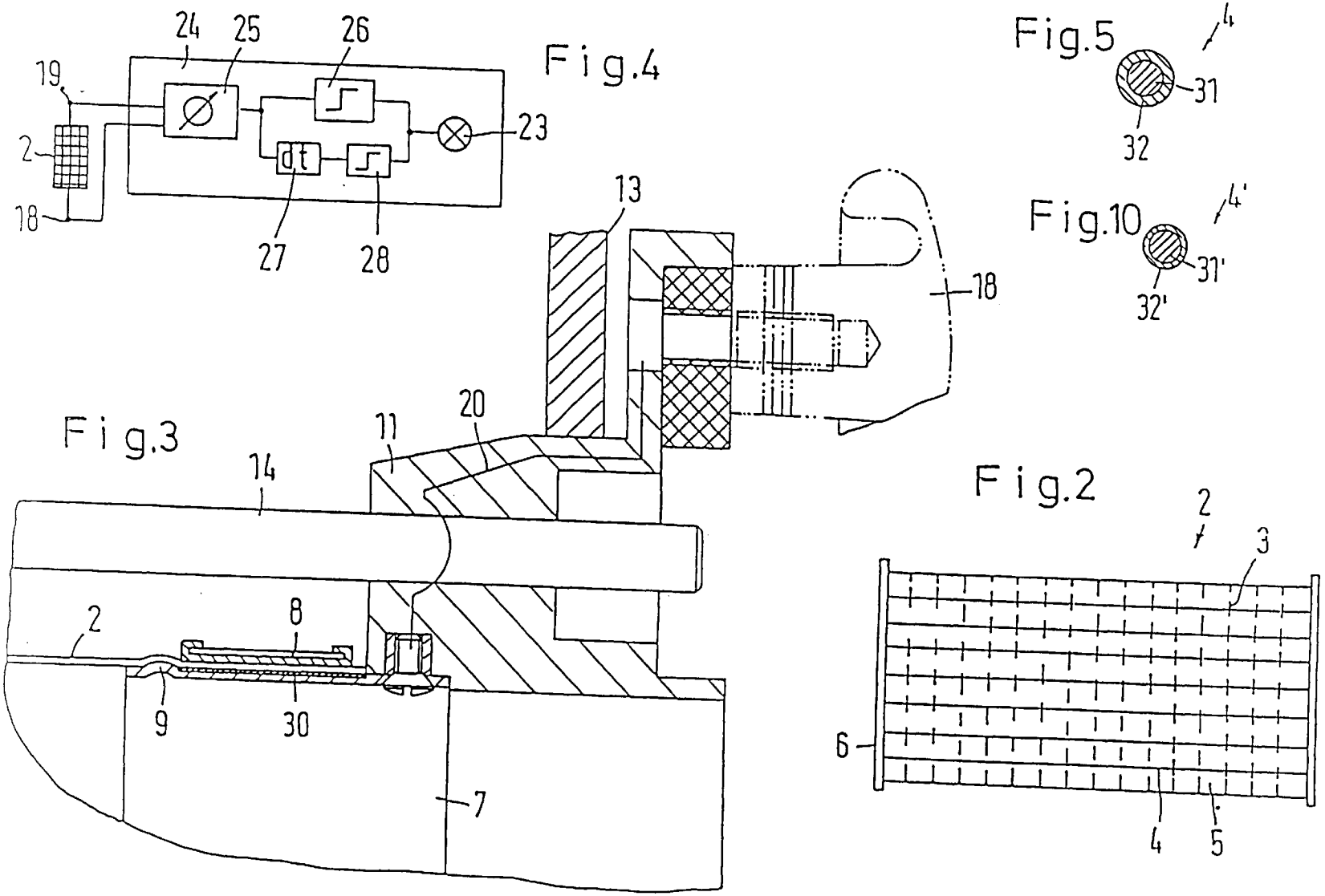
FIG. 2 shows a screen fabric in a top view.
FIG. 3 shows an enlarged section from FIG. 1.
FIG. 4 shows an electric circuit arrangement.
FIG. 5 shows the construction of a conductive thread.
FIG. 10 shows a schematic cross-sectional view of a thread of the screening device according to FIG. 9.

The screen fabric has threads 3 of a first group, shown in dashed lines in FIG. 2, and threads of a second group 4, shown in solid lines in FIG. 2. The threads 3 of the first group form the warp threads of the screen fabric 2 and the threads 4 of the second group form the weft threads of the screen fabric 2. They define screen openings 5 whose size is adapted to the size of the particles of the starting product of a product to be screened.

The threads 3 of the first group are formed by synthetic fibers, e.g., polyester or polyamide. The threads 4 of the second group contain carbon fibers in an electrically conductive relationship, i.e., they can be formed by polyester or polyamide with carbon or can be formed exclusively of carbon fibers. The threads 4 of the second group containing the carbon fibers are accordingly electrically conductive. However, it is also possible to make only the second, third or even the nth thread conductive provided that no opening larger than the maximum permissible particle size in the starting product occurs between the electrically conductive threads 4 of the second group due to thread breakage. As is shown in FIG. 5, the properties of electrical conductivity and mechanical loading capacity can also be distributed among a plurality of materials. In the embodiment example shown in FIG. 5, the thread 4 has a support 31 which is enclosed by a conductive layer 32, e.g., of carbon. The support 31 can be formed of the above-mentioned plastics. The layer 32 need not extend around the entire circumference.

A relatively homogeneous construction of the screen fabric 2 is ensured in that the threads of the first group 3 are formed of polyester, polyamide or a similar plastic and in that the threads 4 of the second group are formed from polyester, polyamide or a similar plastic with carbon or from carbon fibers.

The threads 4 of the second group can also be combined in bundles between individual screen openings so that there are between the individual screen openings not only individual threads but also a plurality of threads which are either twisted or simply arranged parallel to one another. In a thread bundle of this kind, it is sufficient for an individual thread to be electrically conductive.

Two electrode arrangements 6, 7 are arranged at the longitudinal edges of the woven fabric 2 parallel to the threads 3 of the first group. The electrode arrangements 6, 7 connect the threads 4 of the second group in parallel electrically. The electrode arrangements are formed as special-steel rings, the screen fabric 2 resting on their circumference. In this instance (see FIG. 3), it is clamped by means of a clamping ring 8 so as to ensure a reliable electrical contact between the electrically conductive threads 4 of the second group and the electrode arrangements 6, 7. For the purpose of an improved and uniform transition resistance from the special-steel ring to the threads 4 of the screen fabric 2, an auxiliary electrode 30, e.g., in the form of a copper strip, can be arranged between the special-steel ring and the screen fabric 2. Other materials with high electrical conductivity could also be used in place of copper. Every electrode arrangement 6, 7 has a bead 9 between the clamping ring 8 and the intermediate space between the two electrode arrangements 6, 7, which bead 9 impedes removal of the screen fabric 2 from the electrode arrangement 6, 7, the screen fabric 2 being secured to the electrode arrangement 6, 7 by the clamping ring 8.

Each electrode arrangement 6, 7 is arranged in an electrically nonconductive plastic ring 10, 11. The plastic rings 10, 11 are supported in turn in a machine frame 12, 13, not shown in more detail. In most cases, a rotating crusher mechanism, not shown, is provided to ensure the relative motion between the material to be screened and the screen fabric.

The two plastic rings 10, 11 are held apart at a predetermined distance from one another by a plurality of spacers 14, 15. The spacers, of which more than two can also be provided, are held by supporting rings 16. The spacers 14, 15 ensure that the screen fabric 2 receives the required tensioning in the axial direction of the cylinder. Further, the screen fabric 2 is suspended between the electrode arrangements 6, 7 at the spacers 14, 15, e.g., by bands 29.

Figure 1:
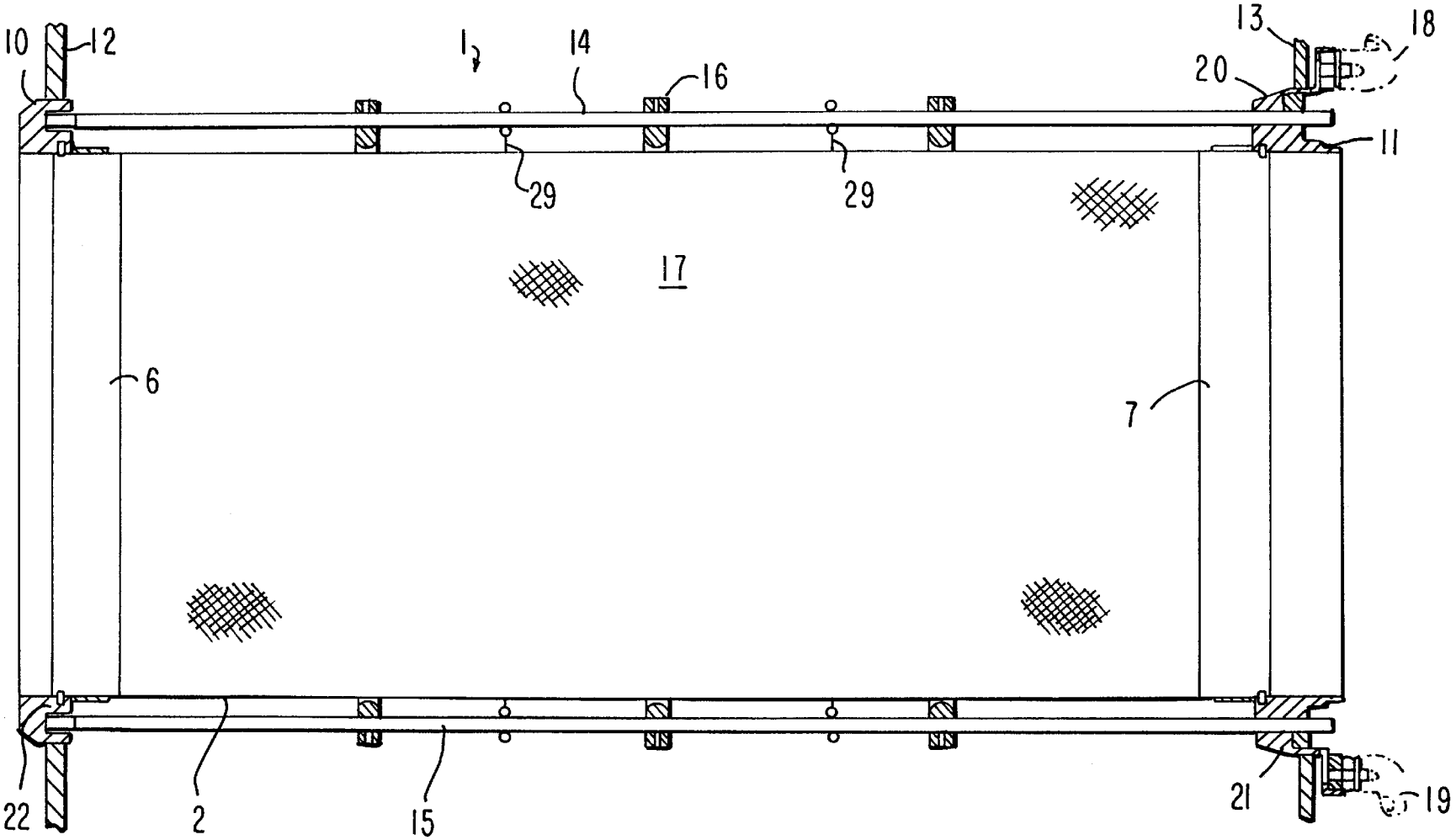
FIG. 1 shows a schematic cross-sectional view of a screening device.

Two electrical connections 18, 19 are provided at one end—the right-hand end as seen in FIG. 1—of the screening drum 17 formed by the screen fabric 2. One electrical connection 18 is connected with the electrode arrangement 7 via an electrical line 20 extending in the plastic ring 11, e.g., via a steel screw which is screwed into the plastic ring 11. The line 20 can be insulated from the spacer 14.

The electrical connection 19 is electrically connected, via a line 21, with the other spacer 15 which is electrically conductive. The spacer 15 is connected with the other electrode arrangement 6 via another electrical line 22 arranged in the plastic ring 11. Thus the necessary electrical signals can be generated and obtained via an individual end side of the screening drum 17, namely from the right-hand end side as viewed in FIG. 1. For example, the resistance of the screen fabric 2 can be measured in the axial direction between the two electrical connections 18, 19. In so doing, the electrical resistance of the spacers 15 can be overlooked, since it is generally constant. If necessary, it can be compensated for by suitable electrical devices.

The screen fabric 2 in its entirety has an electrical resistance in the region of 500 to 1,000 Ω in the axial direction. If only one of the threads 4 of the second group breaks, thee is an increase in the electrical resistance in the region of 0.25 to 0.5 Ω. This increase in resistance can be detected by measuring devices and used as a signal for a break in the screen. Based on the signal, a display 23 can be actuated or the screening drum 17 can be stopped, for example.

FIG. 4 shows a schematic view of an electrical circuit arrangement for evaluating the resistance signal. For this purpose, an evaluating device 24 is provided which is connected with the electrical connections 18, 19 of the screening device 1. The evaluating device 24 has a resistance measuring device 25 which is connected with the two connections 18, 19. A comparator 26 is connected with the resistance measuring device and determines whether or not the resistance value of the screen fabric 2 detected by the resistance measuring device 25 exceeds a predetermined value. If so, the display 23 is actuated. Alternatively or in addition to this, a differential element 27 can also be connected with the output of the resistance measuring device, which output is connected in turn with a comparator 28. The comparator 28 determines whether or not the change in resistance over time remains within a predetermined range. That is, a change in resistance can take place not only due to breakage of a thread 4 of the screen fabric 2, but also due to a change in temperature. However, changes in temperature generally take place more slowly over a period of time, while the change in resistance due to breakage of a thread happens very suddenly. If the evaluating device 24 detects a sudden change in resistance, the display device 23 is likewise actuated. Alternatively, the screening device 1 can also be stopped.

A screening drum 17 is shown in the drawing. But the device can also be used for plansifting.

Figure 6:
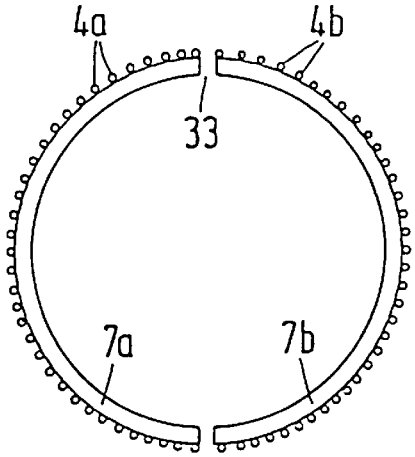
FIG. 6 shows a modified embodiment form of an electrode arrangement.
Figure 7:
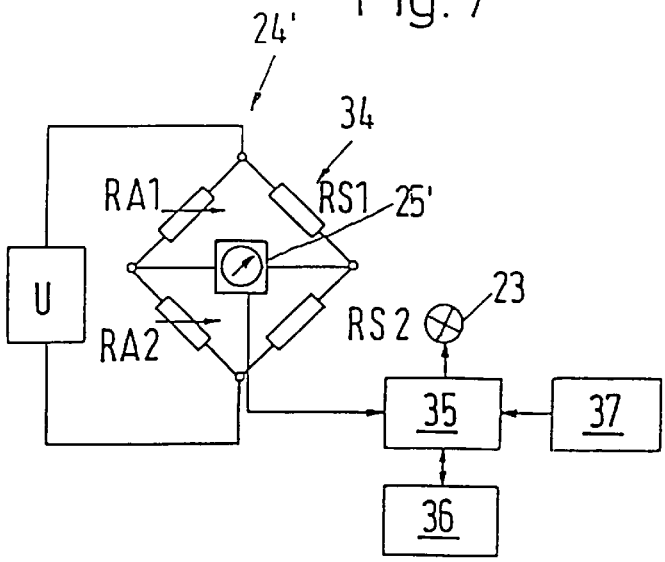
FIG. 7 shows a second construction of a measuring device.

FIG. 6 shows a modified construction in which the electrode arrangements 6, 7 are divided into two parts. The drawing shows two partial electrodes 7*a*, 7*b*, wherein the gap 33 between the two partial electrodes 7*a*, 7*b* is shown as exaggeratedly large. Every partial electrode 7*a*, 7*b* is connected only with a subgroup or partial number of the threads 4 which are designated here by 4*a*, 4*b*. The resistance value of the subgroups 4*a*, 4*b* is determined separately. It will be readily appreciated that the change in resistance when a thread tears is greater than it would be if only a few threads were considered simultaneously. But beyond this, this arrangement has an advantage with respect to circuitry which will be explained with reference to FIG. 7. In this instance, the evaluating device 24' is provided with a bridge 34 which has a resistor RS1 in the upper right bridge branch representing the resistance of the threads of subgroup 4*a*. A resistor RS2 which shows the resistance value of the threads of subgroup 4*b* in a corresponding manner is provided in the lower right branch of the bridge. An adjustable balancing resistor RA1 is provided in the upper left bridge branch. In like manner, a resistor RA2 is provided in the lower left bridge branch. In the non-operating state, the bridge can be balanced in such a way that the resistance measuring device 25' which can be constructed in this instance as a voltmeter, displays a value of 0. If the two resistors RS1, RS2 change resistance in the same direction as can occur due to changing temperature influences, this will not lead to a change in the display of the resistance measuring device 25'. A change in the resistance value and accordingly a change in the display of the resistance measuring device 25' will only take place when the resistors of subgroups 4*a*, 4*b* change in opposite directions, that is, e.g., when a thread in a subgroup 4*a*, 4*b* tears or breaks.

Figure 8:
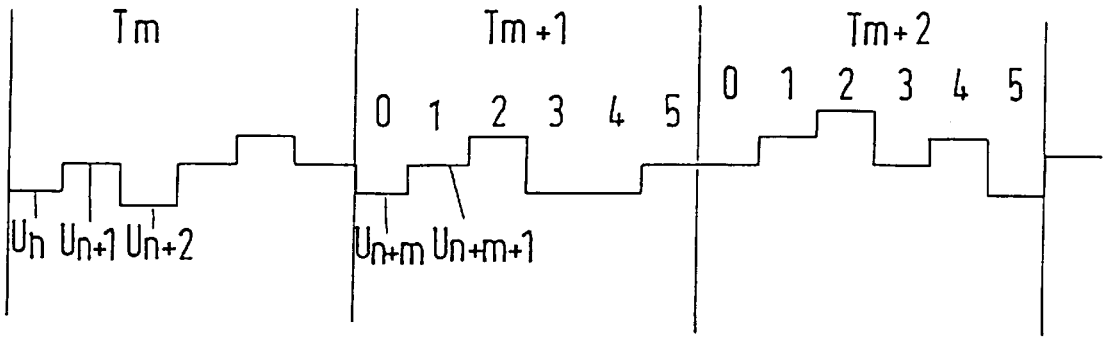
FIG. 8 is a schematic representation of determined measured values.

The resistance measuring device 25' is connected with a control device 35 which reads out measurement values in time intervals and stores them in a storage 36. Therefore, a series of resistance measurement values measured over time is available in the storage 36. FIG. 8 shows a simplified view. Three long time periods Tm, Tm+1, and Tm+2 are shown. Six measurement values $U_n$, $U_{n+1}$, $U_{n+2}$ . . . and $U_{n+m}$, $U_{n+m+1}$, etc. are determined in each long time period. The control device 35 can now carry out short-term comparisons by always determining values which follow one another consecutively or have between them one or more other measurement values. In the present embodiment example, the current value is compared with the next to last value preceding it, e.g., $U_{n+2}$ is compared with $U_n$. If the difference between these two values exceeds a predetermined threshold value, an alarm is triggered. Further, the control device 35 carries out a long-term comparison in that it compares the measured values $U_{n+m}$ with the corresponding measured values of the previous period $U_n$. In this comparison, a long-term trend indicating a gradual deterioration, i.e., an increase in the resistance value, can often be established and the time when the screen fabric 2 must be exchanged can be estimated. Further, a threshold value is determined by a set-value generator 37 and an alarm is triggered when this threshold value is exceeded. This threshold value gives the absolute resistance which may not be exceeded.

Figure 9:
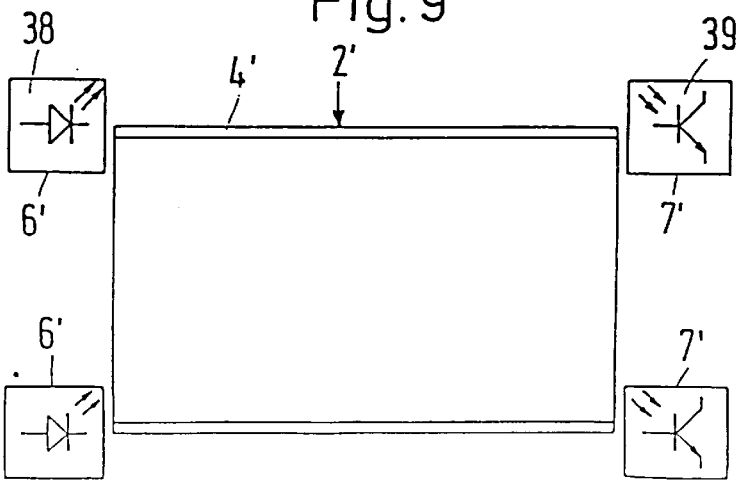
FIG. 9 shows another construction of a screening device in a schematic view.

FIG. 9 shows a schematic view of another construction of a screening device 2' in which the threads 4' of the second group are optically conductive rather than electrically conductive. The threads 4' are shown schematically in section in FIG. 10. An optically conductive core 31' is enclosed by a jacket 32' which prevents light from exiting the core 31'. Light-emitting diodes 38, which can also be designed as laser diodes, and phototransistors 39 which are arranged, respectively, in a frame, not shown in more detail, are provided as input and output arrangements 6', 7'. Alternatively, the screen fabric can be provided at its longitudinal edges with support strips in which are arranged photoelements in fixed assignment to the screen fabric. For this purpose, a light-emitting diode 38 and a phototransistor 39 can be associated with each thread 4' or with a group of threads 4'. When a thread breaks, its light conductivity is interrupted so that the amplification capability of the phototransistor 39 decreases. If required, the light-emitting diodes 38 can also be driven in series in order to monitor the threads 4' by series in a time multiplexing procedure.

We claim:

1. A screening device with a screen fabric having two groups of threads, the threads of one group running substantially orthogonal to the threads of the other group, wherein the screen fabric (2) is conductive for a physical quantity by means of threads (4) of the second group which are spaced at predetermined lateral intervals, in that the threads (4) of the second group are mechanically supported by the threads (3) of the first group and are insulated relative to one another at least in some portions with respect to the physical quantity, and in that, an input electrode and output electrode (6,7) is provided, respectively, at two edges of the screen fabric (2) which extend substantially parallel to the threads (3) of the first group, this input electrode and output electrode (6,7) being connected at least with the conductive threads of the second group.

2. Screening device according to claim 1, wherein all threads (4) of the second group are conductive.

3. Screening device according to claim 1, wherein the physical quantity is electrical current and the conductive threads (4) of the second group are electrically conductive.

4. Screening device according to claim 1, wherein the physical quantity is light and the conductive threads (4) of the second group are designed as light guides.

5. Screening device according to claim 1 wherein the threads (3) of the first group are formed as warp threads and the threads (4) of the second group are formed as weft threads.

6. Screening device according to claim 1 wherein the screen fabric (2) is formed as a synthetic-fiber woven fabric, wherein threads (4) of the second group have fibers which are formed of a plastic which conducts the physical quantity in a conductive relationship.

7. Screening device according to claim 6, wherein the synthetic fiber is formed of polyester or polyamide, the threads (4) of the second group being formed of polyester or polyamide with carbon or from carbon only.

8. Screening device according to claim 1 wherein the conductive threads (4) of the second group have a support (31) in each instance which is covered by a conductive layer (32) at least along a portion of its circumference.

9. Screening device according to claim 1 wherein the threads (4) of the second group are combined to form bundles of at least two individual threads, at least one thread of a bundle being conductive.

10. Screening device according to claim 9, wherein the principle movement direction of the product to be screened relative to the screen fabric is substantially vertical to the threads (4) of the second group, the conductive thread of the thread bundle, there being at least one conductive thread therein, being arranged behind a nonconducting, mechanically stronger thread of the bundle as viewed in the principle movement direction.

11. Screening device according to claim 1, wherein the input electrode and output electrode (6,71 connect at least some of the threads (4) of the second group in parallel for the passage of the physical quantity.

12. Screening device according to claim 1, wherein the input electrode and output electrode (6,7) mechanically support the screen fabric (2).

13. Screening device according to claim 1, wherein the input electrode and output electrode (6,7) are supported, respectively, at a frame (12, 13) via a support (10, 11) which is insulated for the passage of the physical quantity.

14. Screening device according to claim 1, wherein at least one spacer (15) is provided which acts on the input electrode and output electrode (6,7) and tensions the screen fabric (2), which spacer (15) is conductive and is connected at one end with an input or output electrode (6) so as to be conductive and has, at the other end, a connection (19) for the passage of the physical quantity, the other input or output electrode (7) for the passage of the physical quantity being insulated from the spacer (15) and having a suitable connection for the input and output of the physical quantity (18).

15. Screening device according to claim 14, wherein the screen fabric (2) is suspended at the spacer (15) between the two input and output (6, 7) electrodes.

16. Screening device according to claim 14, wherein the spacer (15) is arranged on the delivery side of the screen fabric (2).

17. Screening device according to claim 1 wherein the screen fabric (2) is arranged in the shape of a hollow cylinder (17), the threads (4) of the second group running substantially parallel to the cylinder axis.

18. Screening device according to claim 17, wherein the input electrode and output electrode (6,7) are steel rings.

19. Screening device according to claim 18, wherein an auxiliary electrode (30) with good electrical conductivity is arranged between the steel rings (6, 7) and the conductive threads (4) of the second group.

20. Screening device according to claim 1, wherein the screen fabric (2) is tensioned between the input electrode and output electrode so as to be substantially planar.

21. Screening device according to claim 1, wherein a resistance measuring device (25) is provided, which is connected with the two input and output electrodes, (6, 7) so as to be conductive and which generates a warning signal in the event of an increase in the electrical resistance for the passage of the physical quantity between the input and output electrodes (6, 7).

22. Screening device according to claim 21, wherein the resistance measuring device (25) contains a differential element (27) which determines the change in resistance over time, wherein it triggers the warning signal when the change in resistance per unit of time exceeds a predetermined amount.

23. Screening device according to claim 21 wherein the resistance measuring device (25) has a control device which determines measured values in time intervals and stores them in a storage.

24. Screening device according to claim 23, wherein the control device can subject the measured values to a short-term comparison and a long-term comparison and, if required, can examine them to ascertain whether a predetermined threshold value has been exceeded.

25. Screening device according to claim 1, wherein predetermined quantities of threads (4) of the second group are combined in subgroups and each group is connected with a resistance measuring means (25).

26. The screening device according to claim 25 wherein the resistance measuring means comprises a bridge circuit having a comparator for determining whether the resistance value of the screen fabric detected by said resistance measuring means exceeds a predetermined value.

* * * * *